US009708909B2

(12) United States Patent
Atkinson et al.

(10) Patent No.: US 9,708,909 B2
(45) **Date of Patent: *Jul. 18, 2017**

(54) ACCOUSTIC TRIGGERING DEVICES FOR MULTIPLE FLUID SAMPLERS AND METHODS OF MAKING AND USING SAME

(71) Applicant: SCHLUMBERGER TECHNOLOGY CORPORATION, Sugar Land, TX (US)

(72) Inventors: Malcolm Philip Atkinson, Missouri City, TX (US); John Stevens, Midland, TX (US); Adeel Khan, West Yorkshire (GB); Susanna Fragoso, Houston, TX (US); Laurent Alteirac, Missouri City, TX (US); James G. Filas, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/859,628

(22) Filed: Sep. 21, 2015

(65) Prior Publication Data

US 2016/0010452 A1 Jan. 14, 2016

Related U.S. Application Data

(63) Continuation of application No. 13/193,881, filed on Jul. 29, 2011, now Pat. No. 9,140,116.

(Continued)

(51) Int. Cl.

| | |
|---|---|
| ***E21B 49/08*** | (2006.01) |
| ***E21B 47/16*** | (2006.01) |
| ***E21B 47/12*** | (2012.01) |

(52) U.S. Cl.

CPC ..... *E21B 49/081* (2013.01); *E21B 47/122* (2013.01); *E21B 47/16* (2013.01)

(58) Field of Classification Search

CPC .... E21B 49/081; E21B 47/122; E21B 47/166; E21B 47/12; E21B 49/08

See application file for complete search history.

(56) References Cited

U.S. PATENT DOCUMENTS 6,328,112 B1 12/2001 Malone
6,439,306 B1 * 8/2002 Patel ..... E21B 49/088 166/164

(Continued)

FOREIGN PATENT DOCUMENTS

GB 2445209 A 7/2008

OTHER PUBLICATIONS

International Search Report and Written Opinion issued in equivalent International Application No. PCT/IB2012/052749 mailed Aug. 16, 2013 (11 pages).

(Continued)

*Primary Examiner* — Yong-Suk (Philip) Ro

(74) *Attorney, Agent, or Firm* — Cameron R. Sneddon

(57) ABSTRACT

A method for capturing a sample from a wellbore, comprising the steps of introducing a first message and a second message into a tubing positioned within the wellbore. The first message is directed to a first modem connected to a first sampler device to cause the first sampler device to collect a first sample. The second message is directed to a second modem connected to a second sampler device to cause the second sampler device to collect a second sample.

22 Claims, 7 Drawing Sheets

Related U.S. Application Data

(60) Provisional application No. 61/491,430, filed on May 31, 2011.

(56) References Cited

U.S. PATENT DOCUMENTS

| | | | | |
|---|---|---|---|---|
| 7,510,001 | B2 | 3/2009 | Spring et al. | |
| 9,140,116 | B2 * | 9/2015 | Atkinson | E21B 47/16 |
| 2002/0036085 | A1 | 3/2002 | Bass et al. | |
| 2003/0164240 | A1 | 9/2003 | Vinegar et al. | |
| 2008/0115574 | A1 | 5/2008 | Meek | |
| 2008/0148838 | A1 | 6/2008 | Irani et al. | |
| 2009/0049904 | A1 | 2/2009 | Meister | |

OTHER PUBLICATIONS

International Preliminary Report on patentability issued in the related PCT application PCT/IB2012/052749, dated Dec. 2, 2013 (7 pages).

* cited by examiner

ACCOUSTIC TRIGGERING DEVICES FOR MULTIPLE FLUID SAMPLERS AND METHODS OF MAKING AND USING SAME

CROSS-REFERENCE TO RELATED APPLICATIONS

This application is a continuation of U.S. patent application Ser. No. 13/193,881, filed Jul. 29, 2011, now U.S. Pat. No. 9,140,116, which claims priority to U.S. Provisional Patent Application No. 61/491,430, filed May 31, 2011, each of which are incorporated herein by reference.

BACKGROUND

Field

The present invention relates to the actuation of downhole fluid sampling devices deployed in a wellbore. In particular, the present invention relates to devices and methods for installing multiple fluid sampler devices into a testing apparatus for downhole use, as well as independently actuating downhole fluid sampling devices by an operator from a surface location.

Description of the Related Art

After a wellbore has been drilled, it is desired to perform tests of formations surrounding the wellbore. Logging tests may be performed, and samples of formation fluids may be collected for chemical and physical analyses. The information collected from logging tests and analyses of properties of sampled fluids may be used to plan and develop wellbores and for determining their viability and potential performance.

During a well test, many types of downhole tools such as flow control valves, packers, pressure gauges, and fluid samplers are lowered into the well on a pipe string. Once a packer has been set and a cushion fluid having an appropriate density is displaced in the well above the flow control or tester valve, the valve is opened and hydrocarbons are allowed to flow to the surface where the fluids are separated and disposed of during the test. At various times during the test, the downhole tester valve is closed and the downhole pressure is allowed to build up to its original reservoir pressure. During this time, downhole gauges record the transient pressure signal. This transient pressure data is analyzed after the well test in order to determine key reservoir parameters of importance such as permeability and skin damage. Also during the course of the well test, downhole fluid samples are often captured and brought to surface after the test is completed. These samples are usually analyzed in a laboratory to determine various fluid properties which are then used to assist with the interpretation of the aforementioned pressure data, establish flow assurance during commercial production phases, and determine refining process requirements among other things.

It is often important that these fluid samples be maintained near or above the downhole pressure that existed at the time they were captured. Otherwise, as the sample is brought to surface, its pressure would naturally decrease in proportion to the natural hydrostatic gradient of the well. During this reduction in pressure, entrained gas may be released from solution, or irreversible changes such as the precipitation of wax hydrates or asphaltenes may occur which will render the captured sample non-representative of downhole conditions. For this reason, downhole samplers often have a means to hold the captured fluid sample at an elevated pressure as it is brought to surface.

The sampler device may be lowered into a wellbore on a wireline cable or other carrier line (e.g., a slickline or tubing). Such a sampler device may be actuated electrically over the wireline cable after the sampler device reaches a certain depth. Once actuated, the sampler device is able to receive and collect downhole fluids. After sampling is completed, the sampler device can then be retrieved to the surface where the collected downhole fluids may be analyzed.

In some cases, sampler devices may be attached at the end of a non-electrical cable, such as a slickline. To actuate such sampler devices, an actuating mechanism including a timer may be used. The timer may be set at the surface to expire after a set time period to automatically actuate the sampler devices. The set time period may be greater than the expected amount of time to run the test string to the desired depth.

However, a timer-controlled actuating mechanism may not provide the desired level of controllability. In some cases, the timer may expire prematurely before the sampler device is lowered to a desired location. This may be caused by unexpected delays in assembling the tool string, including wireline and slickline, in the wellbore. If prematurely activated, the sampler devices are typically retrieved back to the surface and the tool string re-run, which may be associated with significant costs and delays in well operation.

During drill stem testing operations, for example, sampler devices have been deployed in multiple numbers assembled in a carrier which can position up to 8 or 9 sampler devices around a flow path at the same vertical position as described in U.S. Pat. No. 6,439,306. Such a sampler tool typically includes a carrier having a first sub (also referred to as a "top sub"), a second sub (also referred to as a "bottom sub"), and a housing which couples the first and second subs together. The sampler devices, including their trigger mechanisms, are attached to the first sub and enclosed within the housing. This assembly is commonly known as a SCAR (which stands for Sampler Carrier) assembly. If it is desired to capture more than one sample at the same time, the SCAR design exposes each sampler device to identical surrounding fluid conditions at the time of triggering. Otherwise, if the different sampler devices were to be distributed a vertical distance along the wellbore, then there can be no assurance that differences in pressure or temperature at the different vertical locations in the wellbore will not affect the well fluid differently causing differences in the captured fluid samples.

Sampler devices of this type have traditionally been triggered using either timer mechanisms programmed at surface before the test or by rupture discs which are burst when it is desired to capture a sample by the application of annulus pressure from a pressure source at the surface. The rupture discs when burst, allow annulus fluid to enter a chamber which contains a piston. The opposing side of the piston is traditionally exposed to a chamber at atmospheric pressure or at some intermediate pressure less than annulus pressure. The pressure differential between annulus pressure and the chamber pressure generates a force on the piston which is attached to a pull rod which then moves with the piston to open a regulating valve which begins the sampling process as described in U.S. Pat. No. 6,439,306.

When the samplers are triggered using rupture discs and a pressure source from the surface in this fashion, and also when it is desired to take samples at different times, many different trigger mechanisms with multiple rupture discs having different burst pressures are needed. Because each disc has an accuracy range associated with it, and it is further desirable to have an unused safety range of pressure between each disc to avoid inadvertently bursting the wrong disc, and because other tools in the test string also rely on this same method of actuation, it is often the case that the maximum allowable casing pressure limits the number of discs that can be deployed in the test string. To overcome this limitation, sampler devices have traditionally been triggered all at once or in a limited number of combined groups. This restriction limits the flexibility of being able to take samples at different times during a well test.

It would therefore be useful to have a method by which each sampler device can be triggered independently when desired and without resorting to supplying pressure from the surface to burst a rupture disc.

One method for actuating one or more of a set of multiple fluid samplers is discussed in US 2008/0148838. In particular, US 2008/0148838 discloses an actuating method in which a control module determines that an appropriate signal has been received by a telemetry receiver and then causes a selected one or more valves to open, thereby causing a plurality of fluid samples to be taken. The telemetry receiver may be any type of telemetry receiver, such as a receiver capable of receiving acoustic signals, pressure pulse signals, electromagnetic signals, mechanical signals or the like. However, locations at which the fluid samples are taken can be extreme high-pressure and high-temperature environments in which the temperature can reach 400° F. and the pressure can reach 20,000 pounds per square inch. In the method for actuating one or more of the set of multiple fluid samplers disclosed in US 2008/0148838 only a single telemetry receiver is disclosed. If an error or malfunction occurs with respect to the single telemetry receiver, then the samples will not be taken resulting in significant delays and increases to the cost of operations.

Thus, there is a need for an improved fluid sampling system having fluid sampling devices that can be independently triggered by an operator located at the surface for collecting one or more fluid samples without the inherent risk of only using a single telemetry receiver. It is to such an improved fluid sampling system that the present disclosure is directed.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In one aspect, the present disclosure describes a method for capturing a sample from a wellbore, comprising the steps of introducing a first message and a second message into a tubing positioned within the wellbore. The first message is directed to a first modem connected to a first sampler device to cause the first sampler device to collect a first sample. The second message is directed to a second modem connected to a second sampler device to cause the second sampler device to collect a second sample.

The first and second modems can utilize any suitable communication medium, such as acoustic waves, electromagnetic waves, pressure waves or the like.

In another aspect, the present disclosure describes a testing apparatus for collecting one or more downhole fluid samples from a wellbore. The testing apparatus is provided with a carrier, a first sampler device and a second sampler device. The first sampler assembly is supported by the carrier. The first sampler assembly is provided with a first sampler device, a first actuator and a first modem. The first sampler device includes one or more first ports, and a first flow control device to control flow through the one or more first ports. The first actuator controls the first flow control device. The first modem has a first transceiver assembly converting messages into electrical signals, and first receiver electronics to decode the electrical signals and provide first control signals to the first actuator responsive to the message being directed to the first modem.

The second sampler assembly is supported by the carrier. The second sampler assembly is provided with a second sampler device, a second actuator and a second modem. The second sampler device includes one or more second ports, and a second flow control device to control flow through the one or more second ports. The second actuator controls the first flow control device. The second modem has a second transceiver assembly converting messages into electrical signals, and second receiver electronics to decode the electrical signals and provide second control signals to the second actuator responsive to the message being directed to the second modem. In one aspect, a significant advantage provided by the testing apparatus is the ability to provide feedback from the first and the second sampler assemblies to the user at surface. The testing apparatus may provide confirmation of receipt of signal in the first and second sampler assemblies and may also have the ability to provide near-real time tool status information to the user.

In yet another aspect, the present disclosure describes a method, comprising the steps of installing a motor and a desiccant bag within a housing of a mechanical module of an actuator for a sampler assembly; and applying a waterproof coating to an exterior surface of the housing. For example, the waterproof coating can be a heat shrink tubing.

Various refinements of the features noted above may exist in relation to various aspects of the present embodiments. Further features may also be incorporated in these various aspects as well. These refinements and additional features may exist individually or in any combination. For instance, various features discussed below in relation to the illustrated embodiments may be incorporated into any of the above-described aspects of the present disclosure alone or in any combination. Again, the brief summary presented above is intended just to familiarize the reader with certain aspects and contexts of some embodiments without limitation to the claimed subject matter.

BRIEF DESCRIPTION OF THE DRAWINGS

Certain embodiments of the disclosure will hereafter be described with reference to the drawings, wherein like reference numerals denote like elements. It should be understood, however, that the accompanying drawings illustrate just the various implementations described herein and are not meant to limit the scope of various technologies described herein. The drawings show and describe various embodiments of the current disclosure. More specifically.

DETAILED DESCRIPTION

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

In the specification and appended claims: the terms "connect," "connection," "connected," "in connection with," and "connecting" are used to mean "in direct connection with" or "in connection with via one or more elements," and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down"; "upper" and "lower"; "upwardly" and downwardly"; "upstream" and "downstream"; "above" and "below"; and other like terms indicating relative positions above or below a given point or element are used in this description to more clearly describe some embodiments of the disclosure. When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
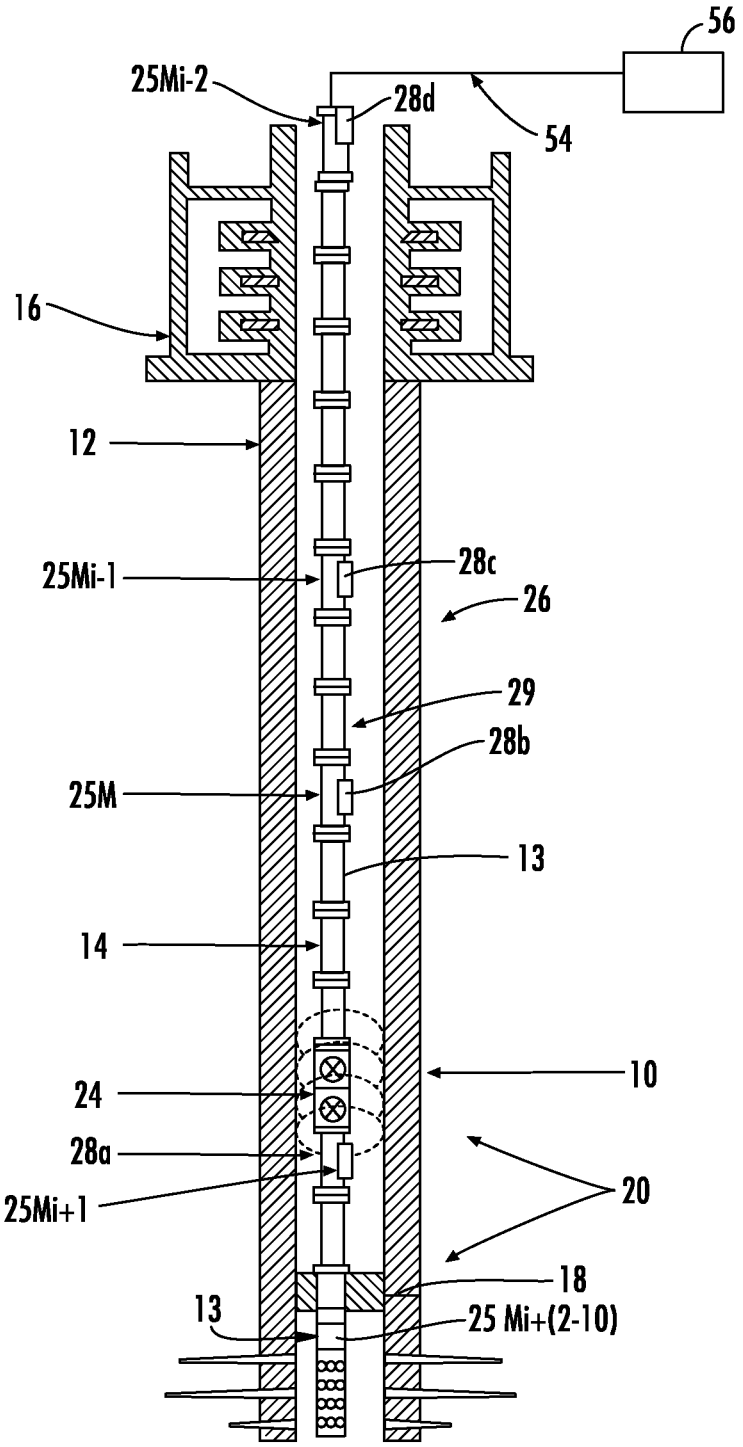
FIG. 1 shows a schematic view of a fluid sampling system according to an embodiment of the present invention.

The present invention is particularly applicable to testing installations such as are used in oil and gas wells or the like. FIG. 1 shows a schematic view of such a system. Once a well 10 has been drilled through a formation, the drill string can be used to perform tests, and determine various properties of the formation through which the well has been drilled. In the example of FIG. 1, the well 10 has been lined with a steel casing 12 (cased hole) in the conventional manner, although similar systems can be used in unlined (open hole) environments. In order to test the formations, it is preferable to place a testing apparatus 13 in the well close to regions to be tested, to be able to isolate sections or intervals of the well, and to convey fluids from the regions of interest to the surface. This is commonly done using a jointed tubular drill pipe, drill string, production tubing, or the like (collectively, tubing 14) which extends from well-head equipment 16 at the surface (or sea bed in subsea environments) down inside the well 10 to a zone of interest. The well-head equipment 16 can include blow-out preventers and connections for fluid, power and data communication.

A packer 18 is positioned on the tubing 14 and can be actuated to seal the borehole around the tubing 14 at the region of interest. Various pieces of downhole equipment 20 are connected to the tubing 14 above or below the packer 18. The downhole equipment 20 may include, but is not limited to: additional packers; tester valves; circulation valves; downhole chokes; firing heads; TCP (tubing conveyed perforator) gun drop subs; samplers; pressure gauges; downhole flow meters; downhole fluid analyzers; and the like.

In the embodiment of FIG. 1, a tester valve 24 is located above the packer 18, and the testing apparatus 13 is located below the packer 18, although the testing apparatus 13 could also be placed above the packer 18 if desired. The tester valve 24 is connected to an acoustic modem 25Mi+1. A gauge carrier 28*a* may also be placed adjacent to tester valve 24, with a pressure gauge also being associated with each acoustic modem. As will be discussed in more detail below with reference to FIGS. 2 and 3, the testing apparatus 13 includes a plurality of the acoustic modems 25Mi+(2-9). The acoustic modems 25Mi+(1-9), operate to allow electrical signals from the tester valve 24, the gauge carrier 28*a*, and the testing apparatus 13 to be converted into acoustic signals for transmission to the surface via the tubing 14, and to convert acoustic tool control signals from the surface into electrical signals for operating the tester valve 24 and the testing apparatus 13. The term "data," as used herein, is meant to encompass control signals, tool status, and any variation thereof whether transmitted via digital or analog.

Figure 2:
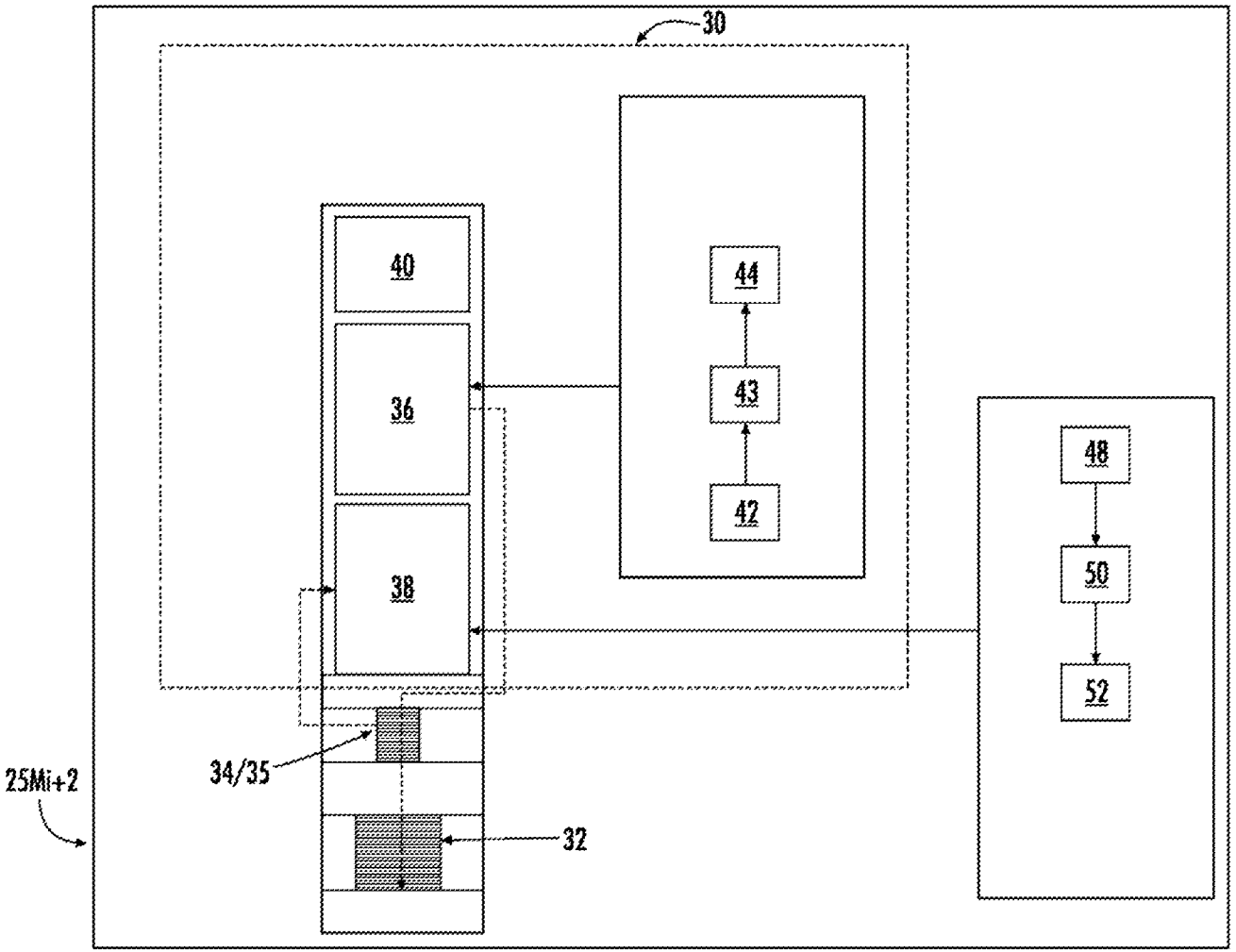
FIG. 2 shows a schematic diagram of an exemplary acoustic modem utilized in embodiments described herein.

FIG. 2 shows a schematic of the acoustic modem 25Mi+2 in more detail. The modem 25Mi+2 comprises a housing 30 supporting a transceiver assembly 32 which can be a piezo electric actuator or stack, and/or a magneto restrictive element which can be driven to create an acoustic signal in the tubing 14. The modem 25Mi+2 can also include an accelerometer 34 and/or monitoring piezo sensor 35 for receiving acoustic signals. Where the modem 25Mi+2 is only required to receive acoustic messages, the transceiver assembly 32 may be omitted. The acoustic modem 25Mi+2 also includes transmitter electronics 36 and receiver electronics 38 located in the housing 30 and power is provided by a power source 40, such as one or more lithium batteries. Other types of power supply may also be used.

The transmitter electronics 36 are arranged to initially receive an electrical output signal from a sensor 42, for example from the downhole equipment 20 provided from an electrical or electro/mechanical interface. The sensor 42 can be a pressure sensor to monitor a nitrogen charge as discussed below, or a position sensor to track a displacement of a piston which controls a sample fluid displacement in a sampler assembly discussed below. The sensor 42 may not be located in the housing 30 as indicated in FIG. 2. For example, the sensor 42 can be located in the sampler assembly. For example, the sensor may connect to the sampler trigger PCB which would in turn connect to the modem as discussed below. Such signals are typically digital signals which can be provided to a micro-controller 43 which modulates the signal in any number of known ways such as PSK, QPSK, QAM, and the like. The micro-controller 43 can be implemented as a single micro-controller or two or more micro-controllers working together. In any event, the resulting modulated signal is amplified by either a linear or non-linear amplifier 44 and transmitted to the transceiver assembly 32 so as to generate an acoustic signal (which is also referred to herein as an acoustic message) in the material of the tubing 14.

The acoustic signal passes along the tubing 14 as a longitudinal and/or flexural wave and comprises a carrier signal with an applied modulation of the data received from the sensors 42. The acoustic signal typically has, but is not limited to, a frequency in the range 1-10 kHz, preferably in the range 1-5 kHz, and is configured to pass data at a rate of, but is not limited to, about 1 bps to about 200 bps, preferably from about 5 to about 100 bps, and more preferably about 50 bps. The data rate is dependent upon conditions such as the noise level, carrier frequency, and the distance between the repeaters. A preferred embodiment of the present disclosure is directed to a combination of a short hop acoustic modems 25Mi−1, 25M and 25Mi+1 for transmitting data between the surface and the downhole equipment 20, which may be located above and/or below the packer 18. The acoustic modems 25Mi−1 and 25M can be configured as repeaters of the acoustic signals. Other advantages of the present system exist.

The receiver electronics 38 of the acoustic modem 25Mi+1 are arranged to receive the acoustic signal passing along the tubing 14 produced by the transmitter electronics 36 of the acoustic modem 25M. The receiver electronics 38 are capable of converting the acoustic signal into an electric signal. In a preferred embodiment, the acoustic signal passing along the tubing 14 excites the transceiver assembly 32 so as to generate an electric output signal (voltage); however, it is contemplated that the acoustic signal may excite the accelerometer 34 or the additional transceiver assembly 35 so as to generate an electric output signal (voltage). This signal is essentially an analog signal carrying digital information. The analog signal is applied to a signal conditioner 48, which operates to filter/condition the analog signal to be digitalized by an ND (analog-to-digital) converter 50. The A/D converter 50 provides a digitalized signal which can be applied to a microcontroller 52. The microcontroller 52 is preferably adapted to demodulate the digital signal in order to recover the data provided by the sensor 42, or provided by the surface. The type of signal processing depends on the applied modulation (i.e. PSK, QPSK, QAM, and the like).

The modem 25Mi+2 can therefore operate to transmit acoustic data signals from sensors 42 in the downhole equipment 20 along the tubing 14. In this case, the electrical signals from the downhole equipment 20 are applied to the transmitter electronics 36 (described above) which operate to generate the acoustic signal. The modem 25Mi+2 can also operate to receive acoustic control signals to be applied to the testing apparatus 13. In this case, the acoustic signals are demodulated by the receiver electronics 38 (described above), which operate to generate the electric control signal that can be applied to the testing apparatus 13.

Returning to FIG. 1, in order to support acoustic signal transmission along the tubing 14 between the downhole location and the surface, a series of the acoustic modems 25Mi−1 and 25M, etc. may be positioned along the tubing 14. The acoustic modem 25M, for example, operates to receive an acoustic signal generated in the tubing 14 by the modem 25Mi−1 and to amplify and retransmit the signal for further propagation along the tubing 14. The number and spacing of the acoustic modems 25Mi−1 and 25M will depend on the particular installation selected, for example on the distance that the signal must travel. A typical spacing between the acoustic modems 25Mi−1, 25M, and 25Mi+1 is around 1,000 ft., but may be much more or much less in order to accommodate all possible testing tool configurations. When acting as a repeater, the acoustic signal is received and processed by the receiver electronics 38 and the output signal is provided to the microcontroller 52 of the transmitter electronics 36 and used to drive the transceiver assembly 32 in the manner described above. Thus an acoustic signal can be passed between the surface and the downhole location in a series of short hops.

The role of a repeater is to detect an incoming signal, to decode it, to interpret it and to subsequently rebroadcast it if required. In some implementations, the repeater does not decode the signal but merely amplifies the signal (and the noise). In this case the repeater is acting as a simple signal booster. However, this is not the preferred implementation selected for wireless telemetry systems of the present invention.

The acoustic modems 25M, 25Mi−1, and 25Mi+1 will either listen continuously for any incoming signal or may listen from time to time.

The acoustic wireless signals, conveying commands or messages, propagate in the transmission medium (the tubing 14) in an omni-directional fashion, that is to say up and down. It is not necessary for the modem 25Mi+1 to know whether the acoustic signal is coming from the acoustic modem 25M above or one of the acoustic modems 25Mi+(2-9) below. The destination of the acoustic message is preferably embedded in the acoustic message itself. Each acoustic message contains several network addresses: the address of the acoustic modem 25Mi−1, 25M, 25Mi+1, or 25Mi+(2-9) originating the acoustic message and the address of the acoustic modem 25Mi−1, 25M or 25Mi+1 that is the destination. Based on the addresses embedded in the acoustic messages, the acoustic modem 25Mi−1, 25M, or 25Mi+1 functioning as a repeater will interpret the acoustic message and construct a new message with updated information regarding the acoustic modem 25Mi−1, 25M, 25Mi+1, or 25Mi+(2-9) that originated the acoustic message and the destination addresses. Acoustic messages will be transmitted from the acoustic modems 25Mi−1, 25M, and 25Mi+1 and slightly modified to include new network addresses.

Referring again to FIG. 1, a surface acoustic modem 25Mi−2 is provided at the head equipment 16 which provides a connection between the tubing 14 and a data cable or wireless connection 54 to a control system 56 that can receive data from the downhole equipment 20 and provide control signals for its operation.

In the embodiment of FIG. 1, the acoustic telemetry system is used to provide communication between the surface and the downhole location.

Testing Apparatus 13

Figure 3:
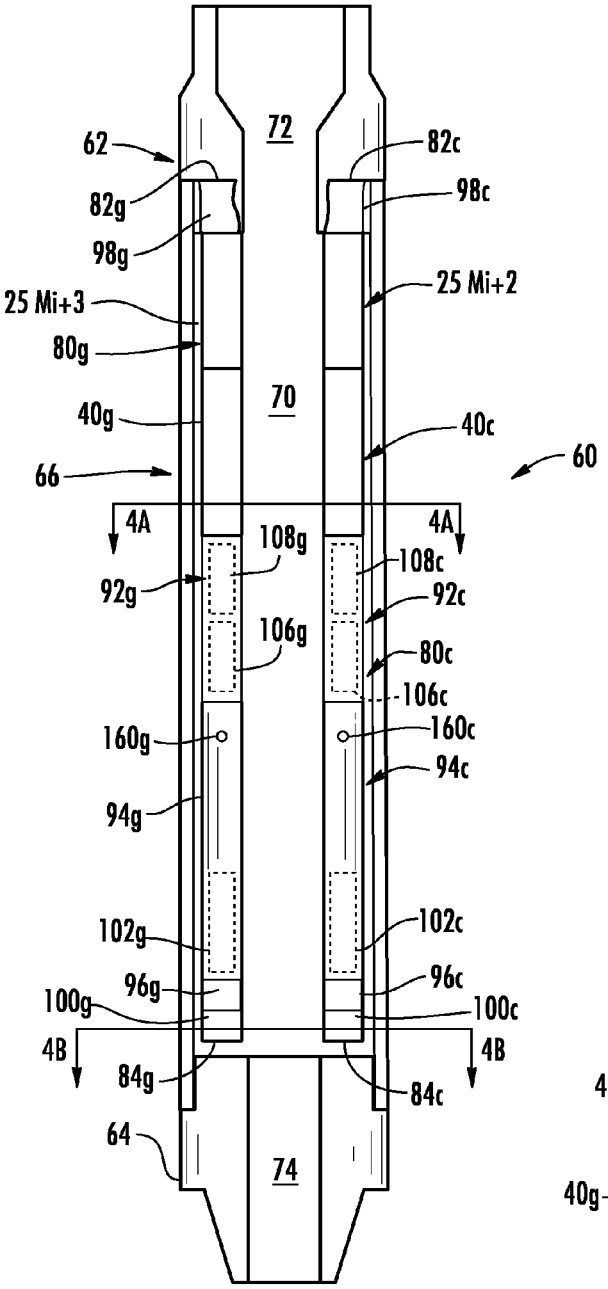
FIG. 3 is a longitudinal sectional view of a testing apparatus in accordance with an embodiment described herein.
Figure 4A:
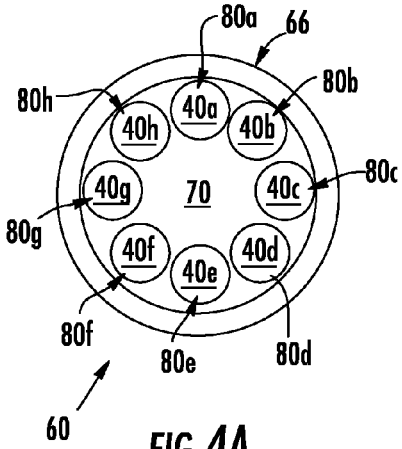
FIG. 4A is a cross-sectional view of the testing apparatus taken along the lines 4A-4A depicted in FIG. 3.
Figure 4B:
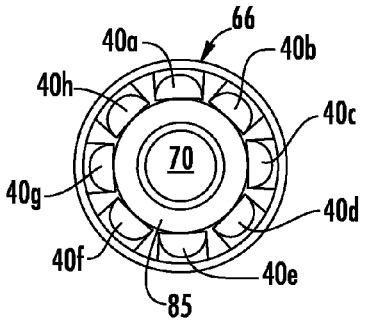
FIG. 4B is a cross-sectional view of the testing apparatus taken along the lines 4B-4B depicted in FIG. 3.
Figure 7:
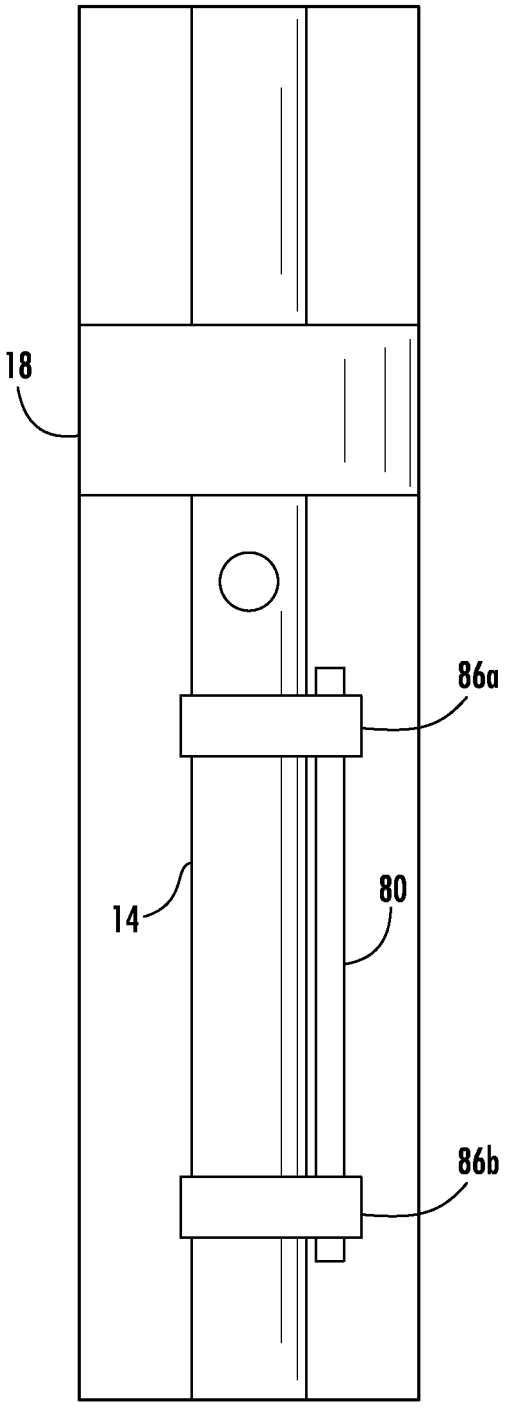
FIG. 7 shows a schematic side view of a testing apparatus in accordance with an alternative embodiment described herein.

Referring to FIGS. 3, 4A and 4B, the testing apparatus 13 is preferably mounted as part of the tubing 14, and includes a carrier 60 having a first sub 62, a second sub 64, and a housing section 66 coupled between the first sub 62 and the second sub 64. An inner bore 70 is defined through the carrier 60 and includes an inner passageway 72 of the first sub 62, and an inner passageway 74 of the second sub 64. According to one embodiment, the housing section 66 defines the inner bore 70 inside the testing apparatus 13 in which one or more sampler assemblies 80 may be positioned. In the illustrated embodiment, eight sampler assemblies 80*a-h* (See FIG. 4) are positioned in the inner bore 70 although more or less of the sampler assemblies 80 can be provided. As will be discussed in more detail below, each of the sampler assemblies 80 has a first end 82 which is connected to the first sub 62, and a second end 84 which is connected to a centralizer assembly 85 which is positioned just above the second sub 64. In an alternative embodiment depicted in FIG. 7, a carrier 60*a* including at least two clamps 86*a* and 86*b* is provided for supporting one or more sampler assemblies 80 outside of the tubing 14.

It should be noted that each of the sampler assemblies 80*a-h* is substantially similar in construction and function and so only one of the sampler assemblies 80*c* will be described in detail hereinafter. In general, the sampler assembly 80*c* is provided with the acoustic modem 25Mi+2, the power source 40*c*, an actuator 92*c*, a sampler device 94*c*, a swivel assembly 96*c*, a first connector 98*c*, and a second connector 100*c*, all of which are rigidly connected together to form an integral assembly. The second connector 100*c* is connected to the centralizer assembly 85. The centralizer assembly 85 is matingly positioned within the housing section 66 to allow the sampler assembly 80*c* to expand and contract with changes in temperature.

Each of the sampler devices 94 preferably forms an independent self-contained system including a nitrogen charge 102. The prior art uses a single nitrogen reservoir to supply all samplers. Hence a failure of their nitrogen storage system would result in a much larger release of energy (i.e., explosion) than the nitrogen charge 102 for each of the sampler devices 94.

The testing apparatus 13 is preferably a modular tool made up of the carrier 60 and a plurality of the sampler assemblies 80*a-h* which can be independently controlled by the surface using the acoustic modems 25Mi+(2-9). The acoustic modem 25Mi+2, for example, communicates with the actuator 92 for supplying control signals to the actuator 92 and for returning a signal to the surface confirming a sampling operation. Incorporating the acoustic modem 25Mi+(2-9) within the sampler assemblies 80*a-h*, for example, permits independent actuation of individually addressed sampler devices 94, via surface activation while also configured to provide receipt of actuation and other diagnostic information. The diagnostic information can include, for example, status of the transmitter electronics 36, status of the receiver electronics 38, status of telemetry link, battery voltage, or an angular position of motor shaft as described hereinafter. In the embodiment shown in FIG. 3, the actuator 92 is integrated both electrically and mechanically with the acoustic modem 25Mi+2. Each sampler assembly 80*a-h* is preferably fully independent providing full individual redundancy. In other words, because each sampler assembly 80*a-h* has its own acoustic modem 25Mi+(2-9), power source 40, actuator 92, and sampler device 94, full redundancy is achieved. For example, if for any reason one of the sampler assemblies 80*a-h* were to fail, the remaining sampler assemblies 80*a-h* can be fired fully independently.

With respect to the sampler assembly 80*c*, the first connector 98*c* is positioned at the first end 82*c* and preferably serves to solidly connect the acoustic modem 25Mi+2 to the first sub 62 to provide a suitable acoustic coupling into the tubing 14. The first connector 98*c* can be implemented in a variety of manners, but for simplicity and reliability is preferably implemented as a threaded post which can engage with a threaded hole within the first sub 62. The second connector 100*c* is positioned at the second end 84*c* and preferably serves to connect the sampler device 94*c* to the centralizer assembly 85 which serves to maintain the second end 84*c* of the sampler device 94*c* out against the housing section 66. The second connector 100*c* is preferably non-rotatably connected to the centralizer assembly 85, and for this reason the sampler assembly 80*c* is provided with the swivel assembly 96*c* to permit installation of the sampler assembly 80*c* into the first sub 62.

More particularly, to install the sampler assembly 80*c* within the carrier 60, the second connector 100*c* is first attached to the centralizer assembly 85, and then the first connector 98*c* is positioned within the threaded hole within the first sub 62. The swivel assembly 96*c* permits the acoustic modem 25Mi+2, power source 40*c*, actuator 92*c* and sampler device 94*c* to be rotated to thread the first connector 98*c* into the threaded hole of the first sub 62 or the second sub 64 while the second connector 100 remains fixed to the centralizer. The swivel assembly 96*c* can be located in various positions within the sampler assembly 80*c*.

The power source 40*c* preferably includes one or more batteries, such as Lithium-thionyl chloride batteries with suitable circuitry for supplying power to the acoustic modem 25Mi+2, as well as the actuator 92*c*. The power source 40*c* may also be provided with circuitry for de-passivating the battery before the actuator 92*c* is enabled to cause the sampler device 94*c* to collect a sample. Circuitry for de-passivating a battery is known in the art and will not be described in detail herein.

The power source 40*c* can be shared between the acoustic modem 25Mi+2 and the actuator 92*c* which provides for a shorter and less expensive power source 40*c*. That is, assuming that the acoustic modem 25Mi+2 and the actuator 92*c* use a voltage level greater than ~5 volts to operate and that a single battery cell using technology suitable for downhole applications typically produces a voltage level ~3 volts then at least 2 battery cells are required in series to produce a voltage greater than 5-6 volts. If the acoustic modem 25Mi+2 and the actuator 92*c* retain its own battery system then each would require at least 2 cells in series to provide an adequate voltage level, which would increase the length of the power source 40*c*.

Figure 8:
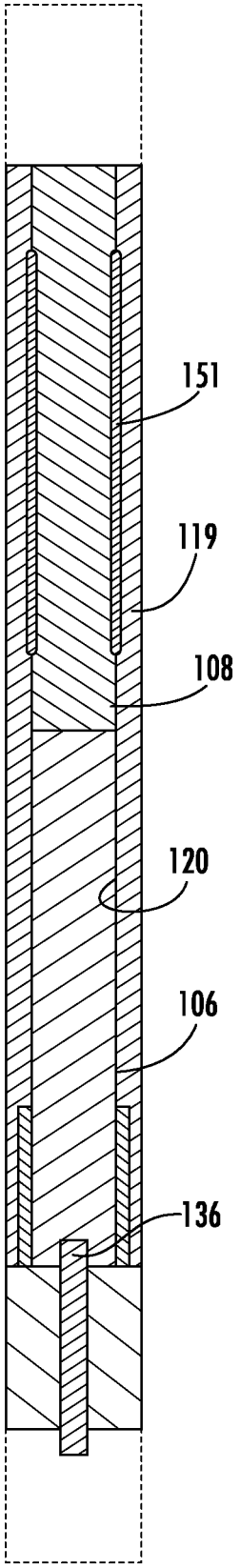
FIG. 8 shows a schematic side view of a testing apparatus in accordance with an alternative embodiment described herein.

The actuator 92*c* is provided with a mechanical module 106*c* and an electronics module 108*c* contained within a tubular outer housing 119 (FIG. 8). The mechanical module 106*c* is connected to the sampler device 94*c* for actuating the sampler device 94*c* to collect a sample. The electronics module 108*c* functions to interpret the control signals received from the acoustic modem 25Mi+2, and to provide one or more signals to cause the mechanical module 106*c* to actuate the sampler device 94*c*. In a preferred embodiment, the electronics module 108*c* can be provided with one or more microcontrollers, and other circuitry for controlling the mechanical module 106*c*.

Figure 5:
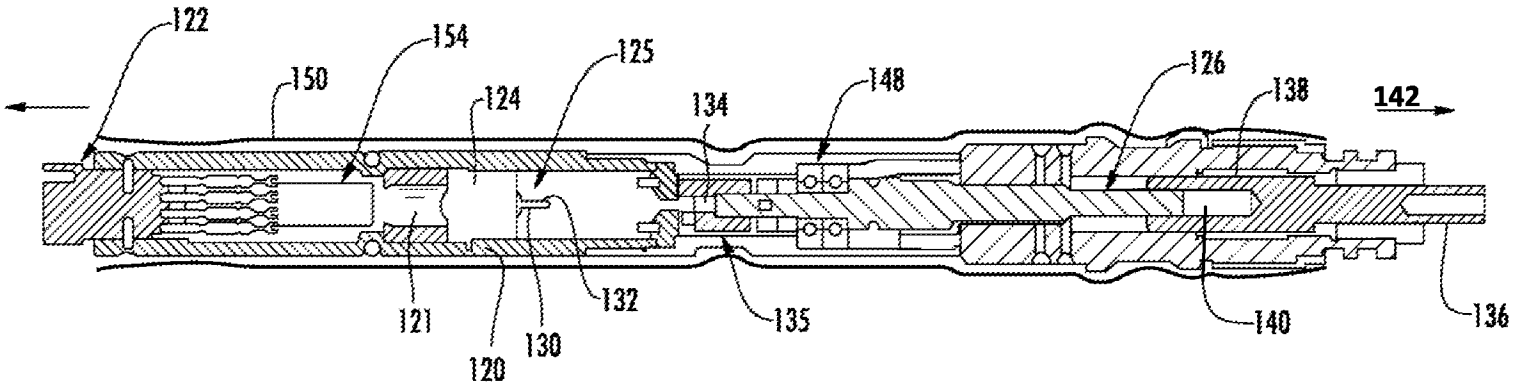
FIG. 5 is a longitudinal sectional view of an exemplary mechanical module in the testing apparatus of FIGS. 3 and 4.

An exemplary partial cross-sectional diagram of the mechanical module 106*c* is shown in FIG. 5. In general, the mechanical module 106*c* is provided with an inner housing 120 defining an inner bore 121, and a connector 122, a motor 124, gearbox 125, and a linkage 126 positioned within the inner bore 121 of the inner housing 120. The connector 122 is adapted to receive one or more control signals from the electronics module 108*c* and to pass such control signals to the motor 124 for actuating and/or de-actuating the motor 124. For example, the connector 122 can be a male or female connector having wires connected to the motor 124.

The motor 124 has a driveshaft 130; and the gearbox 125 has an arbor 132 and a driveshaft shaft 134. The arbor 132 is connected to the driveshaft 130 such that rotation of the driveshaft 130 causes rotation of the driveshaft 134 based upon a predetermined gear ratio. The driveshaft 134 of the gearbox 125 is connected to the linkage 126 via a coupling 135. The linkage 126 is connected to a pin puller 136 of the sampler device 94. In a preferred embodiment, the pin puller 136 includes a threaded bore 138 and the linkage 126 is a lead screw having a threaded shaft 140 position within the threaded bore 138. Thus, rotation of the driveshaft 134 causes rotation of the linkage 126 which causes translational motion (as shown by an arrow 142) of the pin puller 136 thereby actuating the sampler device 94 to take a sample. The linkage 126 can be supported within the inner housing 120 via any suitable assembly, such as one or more bearings 148. Preferably, the bearings 148 are adapted to withstand any radial and axial forces generated during operation.

The motor 124 is preferably a type of motor which is electronically controllable, such as a stepper motor, in which the position of the driveshaft 130 can be controlled precisely without any feedback mechanism by knowing the starting position of the driveshaft 130 and monitoring the commands provided to the motor 124. The commands can include a series of pulses with each of the pulses causing the motor 124 to turn the driveshaft 130 a predetermined angle. Thus, total amount of rotation of the driveshaft 130 can be determined by multiplying the number of pulses by the predetermined angle, and the actual position of the driveshaft 130 can be determined relative to the known starting position. The actual position of the driveshaft 130 can be used to determine the position of the pin puller 136 to verify whether or not the sampler device 94 was successfully triggered. A signal can be generated by the electronics module 108 and sent by the transmitter electronics 36 to the control system 56 indicative of successful or unsuccessful triggering of the sampler device 94.

The mechanical module 106*c* is also designed so as to prevent water vapor from entering into the inner bore 121 within the inner housing 120. For this reason, the mechanical module 106 is provided with seals, such as O-rings between various parts forming the inner housing 120, as well as an optional waterproof coating 150 encompassing the inner housing 120 and applied to an exterior surface of the inner housing 120. The waterproof coating 150 is designed to restrict any moisture ingress into the inner bore 121 formed by the inner housing 120. Preferably, a desiccant bag 154 is also positioned within the inner bore 121 to absorb any additional moisture produced during normal operation of the mechanical module 106. Preferably, the mechanical module 106 is assembled within a chamber (not shown) having humidity below a predetermined level to restrict the amount of moisture within the inner bore 121. Then, the waterproof coating 150 is applied after the inner housing 120 has been assembled and closed to further restrict the penetration of water vapor into the housing 120. The waterproof coating 150 can be constructed of any type of material which is capable of withstanding the heat associated with the downhole environment while also forming a suitable moisture barrier. For example, the waterproof coating 150 can be formed of heat shrink tubing manufactured from a thermoplastic material, such as a fluoropolymer, a polyolefin, a polyvinylidene fluoride, a fluorinated ethylene proplylene, a silicon rubber, a nylon, a neoprene and combinations thereof. When the waterproof coating 150 is constructed of the heat shrink tubing, then assembling the mechanical module 106 will also include a step of applying heat to the waterproof coating 150 to cause the waterproof coating 150 to shrink and conform to the inner housing 120. The electronics module 108 can also be provided with a waterproof coating 151 that is identical in construction and function as the waterproof coating 150, and which is positioned on the electronics module 108 to avoid interfering with other sealing devices, such as threaded connectors and/or O-rings. The inner housing 120 is sized to be positioned in the pressure housing 119, which can be a 1.2 inch diameter pressure housing. The diameter of the housing 120 also preferably matches the diameter of the sampler device 94 and the diameter of the acoustic modem 25Mi+(2-9). Humidity within the mechanical module 106 may be controlled by pre-baking the open assembly in an open oven around 80-90 degrees C. The desiccant bag 154 may be added and the chamber sealed before the assembly cools. A similar procedure can be used for sealing the electronics module 108.

As shown in FIG. 3, each of the sampler devices 94 includes a corresponding set of one or more inlet ports 160*c* (FIG. 3). During run-in, the inlet ports 160 are closed off by corresponding flow control devices, which may be sleeve valves or disk valves. An example of a sleeve valve is illustrated in FIG. 5 of U.S. Pat. No. 6,439,306, and examples of disk valves are discussed in U.S. Pat. No. 6,328,112, which is hereby incorporated by reference. The valves are actuatable by the pin puller 136 to open the ports 160 to enable well fluids in the inner bore 121 to flow into the sampler device 94*c*.

Figure 6:
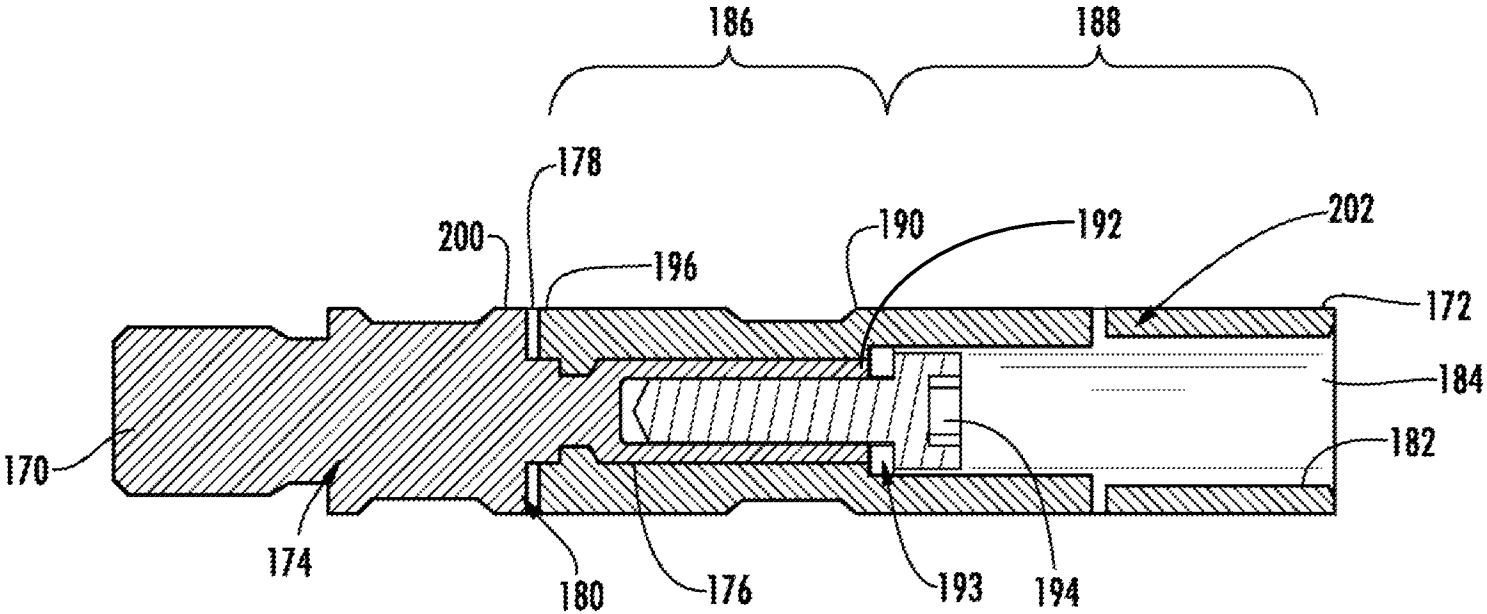
FIG. 6 is a cross-sectional view of a swivel assembly constructed in accordance with the present invention and utilized within embodiments of the testing apparatus depicted in FIGS. 3 and 4.

Shown in FIG. 6 is an exemplary swivel assembly 96 constructed in accordance with the present disclosure. The swivel assembly 96 is provided with a first member 170, and a second member 172 which are connected together so as to permit rotation relative to one another. In the embodiment shown, the first member 170 is provided with a prong 174 which can be connected to the sampler device 94*c*, and a shaft 176 extending from the prong 174. The prong extends outwardly from the shaft 176 to form a shoulder 178. The second member 172 is provided with a first end 180, a second end 182, and a bore 184 extending from the first end 180 to the second end 182 thereof. The bore 184 has a first annular portion 186 which is sized to receive the shaft 176, a second annular portion 188 and a shoulder 190 positioned between the first annular portion 186 and the second annular portion 188. The shaft 176 of the first member 170 and the first annular portion 186 are provided with similar lengths, such that upon insertion of the shaft 176 within the first annular portion, a distal end 192 of the shaft 176 is aligned with the shoulder 190. The shaft 176 can be secured within the first annular portion 186 by any suitable mechanism, such as a threaded fastener 194.

The swivel assembly 96 may also be provided with washers 196 to reduce friction while the first member 170 is rotating relative to the second member 172, and one or more seals 200, such as an 0-ring can be positioned as shown to prevent the ingress of any dirt entering the bore 184 which could affect how easy it is to turn the swivel assembly 96 on removal of the sampler assembly 80*c* from the first sub 62 of the carrier 60.

As there is a possibility that the seal could fail in such a way that pressure could become trapped inside the swivel assembly 96, the second member 172 also preferably includes a weep hole 202 to assure a controlled bleed down of the pressure at the surface.

Thus, as described herein, the sampler assembly 80*c* preferably includes the combined acoustic modem 25Mi+2, power source 40, actuator 92, and sampler device 94*c* as an integral straight, slender-shaped and rigid device which can then be attached to the first sub 62, and the centralizer 85 of the carrier 60, forming a series of fully redundant, independently addressable trigger systems. 7. A sample can be captured from the wellbore, by an operator introducing a first acoustic message into the tubing 14 using the control system 56. The first acoustic message is directed to one or more acoustic modem 25Mi+(2-9), such as the acoustic modem 25Mi+2. In this example, the acoustic modem 25Mi+2 is connected to the sampler device 94*c* to cause the sampler device 94*c* to collect a first sample.

The operator then introduces a second acoustic message into the tubing 14 using the control system 56. The second acoustic message is directed to another one of the acoustic modems 25Mi+(2-9), such as the acoustic modem 25Mi+3, which is connected to the sampler device 94*g* to cause the sampler device 94*g* to collect a second sample. The testing apparatus 13 has the advantage that each sampler device 94 can be triggered independently by sending an acoustic message down the tubing 14, the acoustic message containing a specific address for the intended sampler assembly 80. In this way, all acoustic modems 25Mi+(2-9) receive the acoustic message, but only the acoustic modem 25Mi+(2-9) with the intended address will respond and trigger its corresponding sampler device 94. Hence each sampler assembly 80 can be commanded individually without requiring multiple hydraulic commands and multiple rupture discs to acquire a fluid sample.

Further, it is desirable to capture multiple samples at the same instant, such as either two samples at the same instant or four samples at the same instant in order to have multiple confirmations that the samples are consistent and representative. This can be accomplished by introducing acoustic messages addressed to pre-selected ones of the acoustic modems 25Mi+(2-9) with a command to trigger the corresponding sampler devices 94 and receive individual confirmations that the command was correctly received. The acoustic messages may also include a prescribed delay time to allow for individual communication to occur between the surface and each individual sampler device 94 in order to set up the simultaneous triggering. This allows synchronized sampling of multiple sampler devices 94 while retaining the communication protocol where each acoustic message is destined for a single acoustic modem having a specific receiving address.

The described sampler assemblies 80 can also be used with a hydraulic rupture disc system if so desired. Hydraulic rupture disc systems are known in the art, and an exemplary hydraulic rupture disc system is described in U.S. Pat. No. 6,439,306. The sampler assemblies 80 controlled by a rupture disc will preferably not utilize the acoustic modem 25/mechanical module 106/electronic module 108 described herein but will preferably use the existing trigger detailed in U.S. Pat. No. 6,439,306. Samplers that utilize the hydraulic rupture disc systems may be shorter than those controlled by telemetry so spacer bars may be added to connect the sampler(s) to the centralizer 85.

Further, it should be understood that the sampler assemblies 80 can be actuated using one or more mediums other than stress waves introduced by the acoustic modems 25. For example, the sampler assemblies 80 can utilize modems adapted to communicate using acoustic signals, pressure pulse signals, electromagnetic signals, mechanical signals and the like. As such, any type of telemetry may be used to transmit signals to modems of the sampler assemblies 80.

Although only a few embodiments of the present invention have been described in detail above, those of ordinary skill in the art will readily appreciate that many modifications are possible without materially departing from the teachings of the present invention. For example, those skilled in the art should appreciate that the tubing 14 described herein can also be a slickline cable. Accordingly, such modifications are intended to be included within the scope of the present invention as defined in the claims and those skilled in the art should be able to ascertain, using no more than routine experimentation, equivalents to the specific embodiments of the invention.

The foregoing outlines features of several embodiments so that those skilled in the art may better understand aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A method for collecting sample from a wellbore comprising:

transmitting a first message containing a first address and a first delay time for collecting a first sample into a wellbore;

receiving the first message at a first modem connected to a first sampler device in the wellbore based on the first address corresponding to the first sampler device;

transmitting a second message containing a second address and a second delay time for collecting a second sample into the wellbore, the second delay time being different than the first delay time;

receiving the second message at a second modem connected to a second sampler device in the wellbore based on the second address corresponding to the second sampler device;

initiating collection of a first sample at the first delay time after receipt of the first message by the first modem, via the first sampler device;

initiating collection of a second sample at the second delay time after receipt of the second message by the second modem, via the second sampler device.

2. The method of claim 1, wherein the first and second messages are transmitted at different instants of time.

3. The method of claim 1, wherein the first message is transmitted before the second message; and wherein the first delay time is longer than the second delay time.

4. The method of claim 3, wherein the first delay time is sufficient to allow for transmission of the second message prior to collection of the first sample.

5. The method of claim 1, further comprising transmitting a first confirmation from the first modem to a surface system indicating that the first message was received by, and addressed to, the first modem.

6. The method of claim 5, further comprising transmitting a second confirmation from the second modem to the surface system indicating that the first message was received by, and addressed to, the first modem.

7. The method of claim 5, wherein the first delay time is sufficient to allow for transmission of the first confirmation and the second message prior to collection of the first sample.

8. The method of claim 1, further comprising positioning the first sampler device and the second sampler device in parallel and at a same vertical position within the wellbore.

9. The method of claim 1, further comprising:

collecting the first sample at the first delay time via the first sampler device; and collecting the second sample at the second delay time via the second sampler device, wherein the first delay time and the second delay time differ such that the first and second samples are collected simultaneously.

10. The method of claim 1, further comprising transmitting a signal from the first modem or the second modem to a surface system, wherein the signal is indicative of a successful or unsuccessful collection of a sample by the first sampler or second sampler device.

11. A test apparatus for collecting samples from a wellbore comprising:

a first sampler assembly comprising:

a first modem configured to receive a first message directed thereto and to generate first control signals based upon the first message;

a first sampler device; and a first actuator, the first actuator comprising:

a housing;

a mechanical module within the housing to control fluid flow into the first sampler device so as to cause collection of a first sample;

an electronic module within the housing to operate the mechanical module responsive to the first control signals; and a waterproof coating on the electronic module; and a second sampler assembly comprising:

a second modem configured to receive a second message directed thereto and to generate second control signals based upon the second message that cause the second sampler assembly to collect a second sample.

12. The test apparatus of claim 11, wherein the waterproof coating comprises heat shrinking tubing.

13. The test apparatus of claim 11, wherein the first sampler assembly further comprises a waterproof coating on the mechanical module.

14. The test apparatus of claim 11, wherein the mechanical module comprises a pin puller and a stepper motor to actuate the pin puller responsive to the electronic module.

15. The test apparatus of claim 11, wherein the first message contains a first address; wherein the first modem generates the first control signals based on the first address corresponding to the first sampler device; wherein the second message contains a second address; wherein the second modem generates the second control signals based on the second address corresponding to the second sampler assembly.

16. The test apparatus of claim 15, wherein the first message also contains a first delay time for collecting the first sample; wherein the second message also contains a second delay time for collecting the second sample; wherein the electronic module operates the mechanical module responsive to the first control signals such that the mechanical module causes collection of the first sample at the first delay time after receipt of the first message by the first modem; wherein the second control signals cause the second sampler assembly to collect the second sample at the second delay time after receipt of the second message by the second modem; and wherein the first delay time and second delay time differ such that the first and second samples are collected simultaneously.

17. The test apparatus of claim 16, wherein the first modem receives the first message before the second modem receives the second message; and wherein the first delay time is sufficient to allow for transmission of the second message prior to collection of the first sample.

18. The testing apparatus of claim 11, wherein the first sampler assembly has a first end and a second end, and a first connector positioned adjacent to the first end, and a second connector, and wherein the first sampler assembly includes a swivel assembly positioned between the first connector and the second connector such that the first connector can rotate relative to the second connector.

19. A testing apparatus for collecting one or more downhole fluid samples from a wellbore, comprising:

a carrier; and a first sampler assembly supported by the carrier, the first sampler assembly comprising:

a first sampler device including one or more first ports, a first flow control device to control flow through the one or more first ports;

a first actuator to control the first flow control device;

a first modem having a first transceiver assembly converting messages into electrical signals, and first receiver electronics to decode the electrical signals and provide first control signals to the first actuator responsive to a message being directed to the first modem; and wherein the first sampler assembly has a first end and a second end, and a first connector positioned adjacent to the first end, and a second connector, and wherein the first sampler assembly includes a swivel assembly positioned between the first connector and the second connector such that the first connector can rotate relative to the second connector.

20. The testing apparatus of claim 19 further comprising:

a second sampler assembly supported by the carrier, the second sampler assembly comprising:

a second sampler device including one or more second ports, a second flow control device to control flow through the one or more second ports;

a second actuator to control the second flow control device; and a second modem having a second transceiver assembly converting messages into electrical signals, and second receiver electronics to decode the electrical signals and provide second control signals to the second actuator responsive to a message being directed to the second modem.

21. The testing apparatus of claim 19, wherein the first actuator comprises:

an electronics module; and a mechanical module, the mechanical module having a stepper motor and a pin puller with the pin puller linked between the stepper motor and the first flow control device; and wherein the electronics module monitors a position of the stepper motor and generates a trigger signal indicative of a successful or unsuccessful collection of a sample by the first sampler device.

22. The testing apparatus of claim 21, wherein the first modem includes transmitter electronics providing electrical signals to the first transceiver assembly to cause the first transceiver assembly to generate a message, and wherein the electronics module provides the trigger signal to the transmitter electronics of the first modem.

* * * * *